US005707063A

United States Patent [19]

Tzeng et al.

[11] Patent Number: 5,707,063

[45] Date of Patent: Jan. 13, 1998

[54] AMUSEMENT SYSTEM

[75] Inventors: Feng-Tzer Tzeng, Rockville, Md.; Chihchen Chang, Palatine, Ill.

[73] Assignee: Cybernetics InfoTech, Inc., Gaithersburg, Md.

[21] Appl. No.: 567,103

[22] Filed: Dec. 4, 1995

[51] Int. Cl.[6] ..... A63B 67/00

[52] U.S. Cl. ..... 273/440

[58] Field of Search ..... 473/459; 273/318, 273/440

[56] References Cited

U.S. PATENT DOCUMENTS

| | | | |
|---|---|---|---|
| 2,054,738 | 9/1936 | Carr . | |
| 3,933,354 | 1/1976 | Goldfarb et al. . | |
| 4,352,348 | 10/1982 | Griffith . | |
| 4,353,545 | 10/1982 | Anderson . | |
| 5,402,999 | 4/1995 | Keehn, Sr. | 473/472 |

*Primary Examiner*—William H. Grieb

*Attorney, Agent, or Firm*—Donald Kettlestrings

[57] ABSTRACT

The amusement exercise system of the present invention, features a new physical workout system and a new ball-shooter. The workout system emulates a fighting (combat) environment where the player (the person who workouts) fights against the ball shooter. The player throws balls at the ball-shooter while the ball-shooter shoots at the player with a plurality of different-colored balls (to signal different defensive actions by the player) and with pseudo-random striking positions. A ball-collecting net is erected behind the player to collect balls shooting from the ball-shooter. Similarly, a ball-collecting target is erected at the shooter to collect balls thrown by the player. Scores are kept by counting balls inside the net and the target after each fighting run. This amusement workout system provides intensive two-way player-shooter interactions, and allows individuals or group players to enjoy the fun of playing miscellaneous sports and games simultaneously, and at the same time, to achieve whole-body workout, while requiring only limited playing space.

14 Claims, 9 Drawing Sheets

Two example shooting patterns:

pattern 1

| | | | | |
|---|---|---|---|---|
| 0000100001 | 0000100001 | 0000100001 | 0000100001 | 0000100001 |
| 0000100001 | 0000100001 | 0000100001 | 0000100001 | 0000100001 |
| 0000100001 | 0000100001 | 0000100001 | 0000100001 | 0000100001 |
| 0000100001 | 0000100001 | 0000100001 | 0000100001 | 0000100001 |
| 0000100001 | 0000100001 | 0000100001 | 0000100001 | 0000100001 |
| 0000100001 | 0000100001 | 0000100001 | 0000100001 | 0000100001 |

pattern N

| | | | | |
|---|---|---|---|---|
| 0000010010 | 0000001000 | 0010010010 | 0001000000 | 1101000100 |
| 0000001000 | 0001010000 | 0001000000 | 0000011010 | 0100000000 |
| 0010001000 | 0001010000 | 0000111010 | 0000000010 | 0000100000 |
| 0000100000 | 0000110100 | 1101001010 | 0101000000 | 0000001010 |
| 0000000010 | 0000010000 | 0001001000 | 0010000010 | 0010000100 |
| 0000011010 | 1001001100 | 1000000000 | 0000000000 | 1100000000 |

AMUSEMENT SYSTEM

FIELD OF THE INVENTION

The present invention is directed to the field of amusement exercise systems.

BACKGROUND OF THE INVENTION

Ball games and other sports such as soccer, hockey, dodgeball, basketball, baseball, softball, boxing, fencing and so on; and video games such as spaceship fighting, kung-fu fighting, and so on; are very popular. For fun workout by playing ball games or other sports, however, group players and large outdoor or indoor arenas are usually required. Video games can be played alone and do not require large space. However, no real whole-body workout are achieved. Aerobic dances and workout using exercise machines such as treadmills, skiers, stationary bikes, and so on, can achieve the same fitness goals without the need of large arenas and group players. However, these exercises offer much less fun.

Some commercially-available sports equipment and toys were developed to solve part of the above problems. For example, baseball pitching machines, tennis/table tennis serving machines, toy guns, darts, and so on, are used so that a player can achieve some exercises or practice some sports techniques (hitting, returning, shooting, etc.) alone, without a partner, and within limited playing space. However, these devices only provide limited physical workout, monotone playing methods, and minimum player-machine interaction.

In other related prior arts, U.S. Pat. No. 2,054,738 to Carr, for "Game Apparatus," discloses a ball throwing and catching machine for muscle exercises. However, this device facilitates only limited exercises and limited one-way action (player catching balls). U.S. Pat. No. 3,933,354 to Goldfarb, et al, for "Reflex Testing Amusement Device," discloses an amusement device using lights to indicate positions for a player to hit. Again, this device facilitates only limited exercises (player can stand still) and limited one-way action (player hitting lighted areas). U.S. Pat. No. 4,353,545 to Anderson, for "Athletic Reflex Machine," discloses a martial-arts practice apparatus including an upright panel with a plurality of pneumatically actuatable strikers valve-controlled to lash out toward a user and retract in simulation of weaponless combat. This device again facilitates only limited one-way action (player defending) and monotone playing method. U.S. Pat. No. 4,352,348 to Griffith, for "Soccer Ball Practice Machine," discloses a soccer ball practice machine. However, this device facilitates only limited exercise and limited one-way action (player kicking the ball).

SUMMARY OF THE INVENTION

The present invention overcomes the above and other problems by providing an innovative exercise system. This exercise system features a new amusement physical workout system and a new ball shooter (SHOOTER). The workout environment emulates a fighting (combat) environment where the person who workouts (PLAYER) fights against the shooter. A gun (GUN) inside the shooter shoots a plurality of different-colored balls (BALLS) at the player while the player throws balls at the shooter. A ball-collecting net (NET) is erected behind the player to collect balls shot from the shooter. Similarly, a ball-collecting target (TARGET) is erected at the shooter to collect balls thrown by the player. Scores are kept by counting balls inside the net and the target after each fighting run.

The target at the shooter is constructed to facilitate flexible ball throwing at it by the player in various ways such as by emulating baseball pitching, basketball shooting, horseshoe tossing, football punting, and so on. The net at the player's side covers an area much larger than the player's body to collect balls shot from the shooter into various, pseudo-random positions of the net. Two different-colored balls (e.g., red and green) are shot out from the shooter. The rule of the game (RULE) is for the player to block all green balls while dodge all red balls. The shooter controls the shot timing and the ball locus by using an electronic shot controller and a planetary gear-train system (driven by a motor), respectively. A ball-loader (LOADER), which contains an auto-loading ball pan, stores and feeds balls to the shooter.

This amusement workout system provides intensive two-way player-shooter interactions, and allows individuals or group players to enjoy playing miscellaneous fun sports and games, such as goal-keeping, ball-dodging, basketball shooting, baseball pitching, horseshoe tossing, football punting, spaceship fighting, kung-fu fighting, and so on, simultaneously, and at the same time, to achieve truly whole-body workout, while requiring only limited playing space.

The above and other features, objectives, and advantages of the invention are disclosed in or will be apparent from the following description of the preferred embodiments.

BRIEF DESCRIPTION OF THE DRAWINGS

The preferred embodiments are described with reference to the appended drawings in which, for the amusement exercise system of the present invention.

DESCRIPTION OF THE PREFERRED EMBODIMENTS

Although the present invention will be described herein with the preferred embodiments, it should be noted that the present invention and the advantages derived therefrom are not to be limited by the illustrated embodiments.

Figure 1:
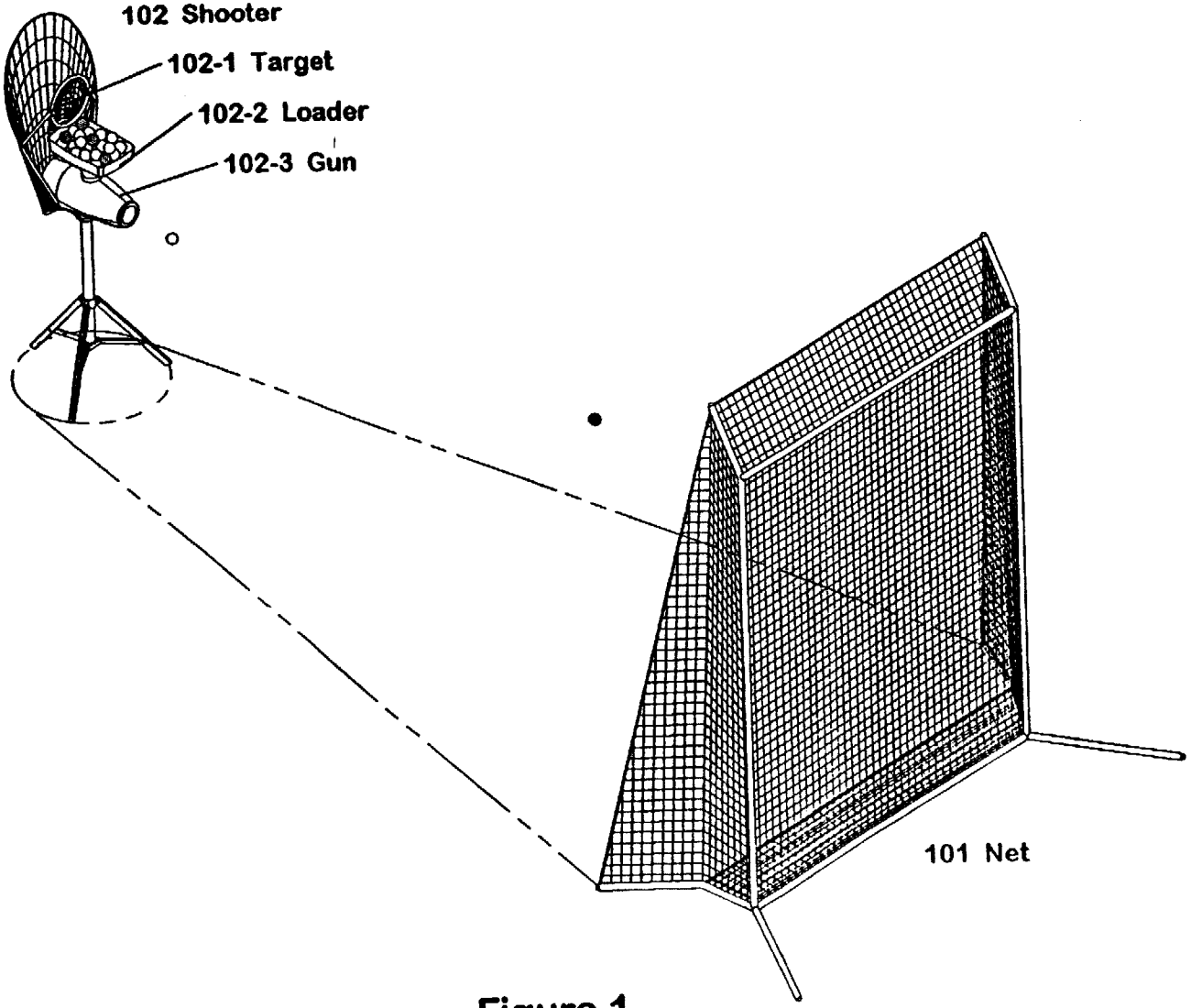
FIG. 1 illustrates the overall system.

Referring to FIG. 1, for workout, the player stands in front of the net 101 and faces the shooter 102. For "DEFENSE" play, the shooter 102 shoots balls with two different colors (red and green) into various, pseudo-random positions of the net 101 (with striking position controlled by ball locus and shot timing, as described later). The rule of defense is for the player to block green balls and dodge red balls. By simply counting the number of red and green balls in the net 101 after each run of the game, the defensive score is set equal to the number of red balls (dodged) subtracts the number of green balls (not blocked) in the net 101. The best defensive player is the one with the highest score.

The use of two different-colored balls to signal different (dodge or block) physical actions by the player is key to this system. Otherwise, it would be too easy for a player just to dodge balls only (e.g., simply staying away from the net 101), or to block balls only (e.g., simply staying in the middle of the net 101). The purpose for fun exercises would be completely lost. The two different-colored balls would force the player to move away from the center of the net 101 to dodge red balls, and to come back to it to block green balls. For advanced plays, more than two different-colored balls can be used to signal various physical actions, e.g., blue balls signal "to block by foot", yellow balls signal "to catch by hand", black balls signal "to dodge without moving your feet", and so on.

For "FIGHTING" play, the shooter 102 shoots balls at the player and the player throws balls (whim-colored balls, to distinguish from the red and the green balls of the shooter 102) at the target 102-1 of the shooter 102. The player has to empty his balls before the shooter empty its balls. The offensive score of the player is counted as the number of white balls in the target 102-1 after each fighting ran. The defensive score is counted as in the "DEFENSE" play.

For "OFFENSE" play, the player throws balls at the target 102-1. No balls are shot at the player. The offensive score of the player is counted as in the "FIGHTING" play.

From the player's perspective, since the red and the green balls aim at various, pseudo-random locations within the net 101, to dodge or block these balls, sometimes almost at the same time (depending on the shot timing), and in the mean time, to throw white balls at the target 102-1, require fast body and limb movement. These movements can be anything, including spiking, catching or kicking to block balls; jumping, ducking or slanting to dodge balls; and pitching, shooting, tossing or punting to hit the target 102-1. The game also requires intense concentration and quick response in deciding (which color) and moving to block or dodge balls.

To illustrate a typical game, 60 balls (30 red and 30 green) are stored in the auto-loading ball pan of the loader 102-2, and 10 white balls are carried by the player (using a Fanny bag, for example). The shooter 102 shoots out all 60 balls within a 5-minute period. The player can throw his balls anytime he wants, as long as he empties his balls before the shooter empties its balls. Another option is that the player can throw balls only in certain time slot. For example, the player can throw one ball every time after the shooter 102 shoots a multiple of 5 balls (5, 10, 15, and so on), and before the shooter 102 shoots the next ball (or, the next two, three, and so on, balls). An electronic counter can be used to count the number of balls the shooter 102 has already shot out, and to switch on and off a light to indicate such periods when the player can throw balls. In essence, this implements an automatic on-off target. The player can throw as many balls as he wishes during the target-on periods, or, optionally, just one ball during a target-on period. In the latter case, if the player does not throw one ball during a particular target-on time slot, he forfeits his shot at that time.

For group plays, players can take turns blocking or dodging balls. Multiple different-colored balls can be used to signal combinations of different players and different actions (e.g., gray balls signal player-A to block by foot). The players can also take turns throwing balls at the shooter 102 in the same way played by a single player. Multiple shooters 102 can also be placed together for complicated plays. For example, several balls can be shot out at the same time from different shooters 102.

For safety reasons, soft, deformable balls are used. These balls are commonly used in toy guns with their size a bit larger than a ping-pong ball. Goggles to protect eyes are not necessary, but their use are recommended.

The exercise system can be built into a small-sized version (as described herein) for home and recreational use, and a larger-sized, more powerful version with larger and faster (speed) balls for professional and institutional use (in a larger arena such as a racketball court). For professional or amateur athletes, by playing dodging and blocking in the "defense" mode, training of techniques used in fighting (boxing, karate, martial arts, fencing, and so on) and goal-tending (soccer, hockey, water polo, handball, and so on) can be accomplished.

For the present invention, various other playing methods and embodiments are possible, including, but not limited to, the following:

"Robot-to-robot fighting" in which person-manipulated robots throw balls at each other like the shooter 102, but also defends like the player as described above, i.e., to block or to dodge depending on the color of balls (judged by the persons manipulating the robots).

Using person-manipulated robot to throw balls at the shooter 102, and to block or to dodge balls shot from the shooter 102 (also judged by the person manipulating the robot).

Using different lights at the shooter as identification signal for inducing blocking/dodging actions from the player, instead of using different-colored balls;

Replacing different-colored balls shot from the shooter by different-shaped objects;

Replacing ball-shooter by water guns or mud guns;

Replacing the player's ball-throwing by dart-pitching or gun-shooting;

Replacing the steady target of the shooter by a moving or electronically-programmed on-off target with automatic score-counting striking zones.

Figure 2:
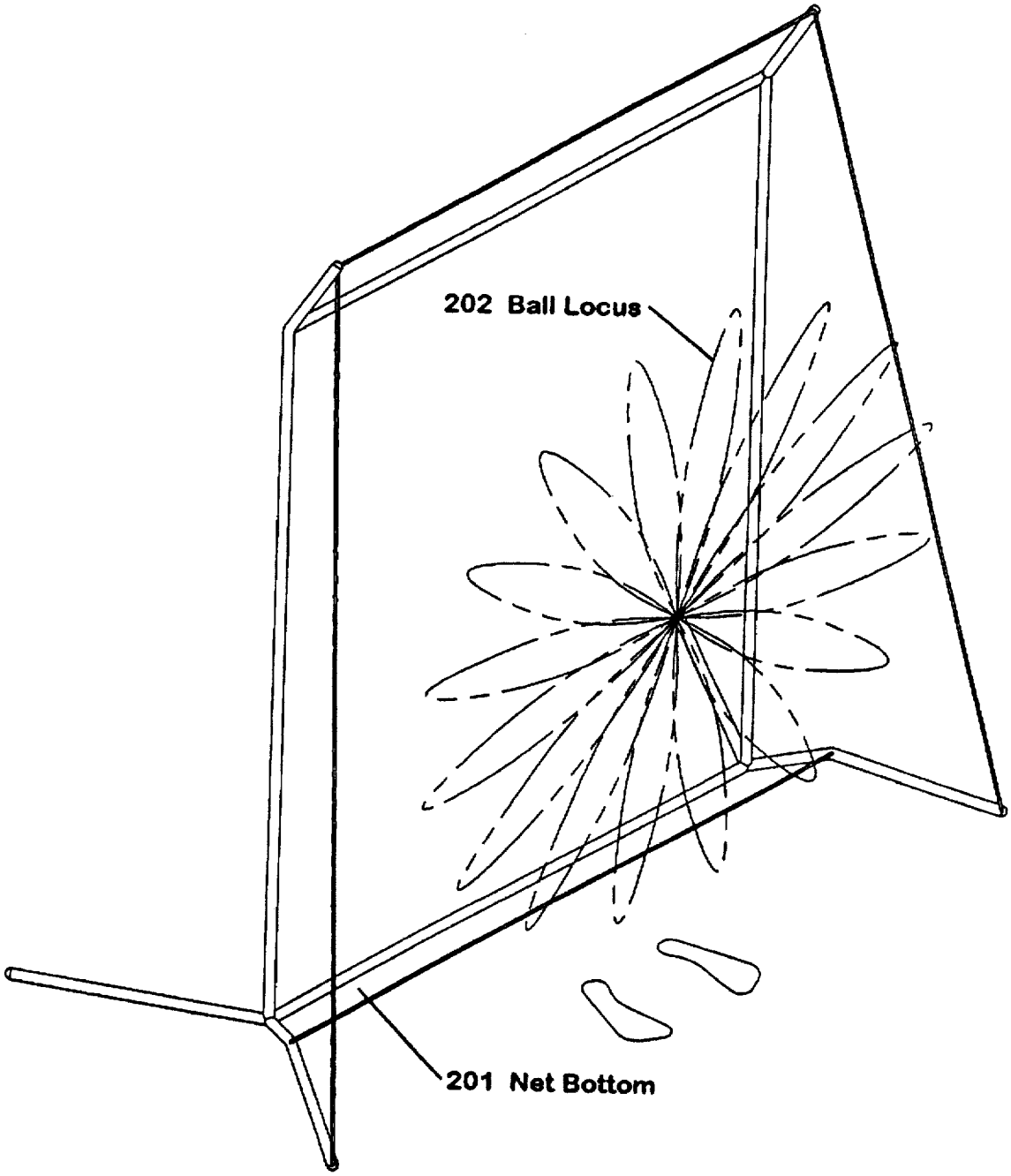
FIG. 2 illustrates the net (101 of FIG. 1) and the ball locus.

Referring to FIG. 2, the net 101 is a simple structure to collect balls shot from the shooter 102. All balls, unless hitting the player or blocked by the player, will enter the net 101. The bottom part 201 of the net 101, with a twisted-bar structure, is so designed such that balls coming into the net will stay inside, not running outside of the net. The height and width of the net 101 are fixed at about 8' and 6', respectively. A net 101 with adjustable height and width can also be used. The net 101 is designed for easy assembly and de-assembly. The ball locus 202 shows a circular area (with a diameter of about 5.4' for the net 101 described herein) encompassing the locus of striking points (described later).

Figure 3:
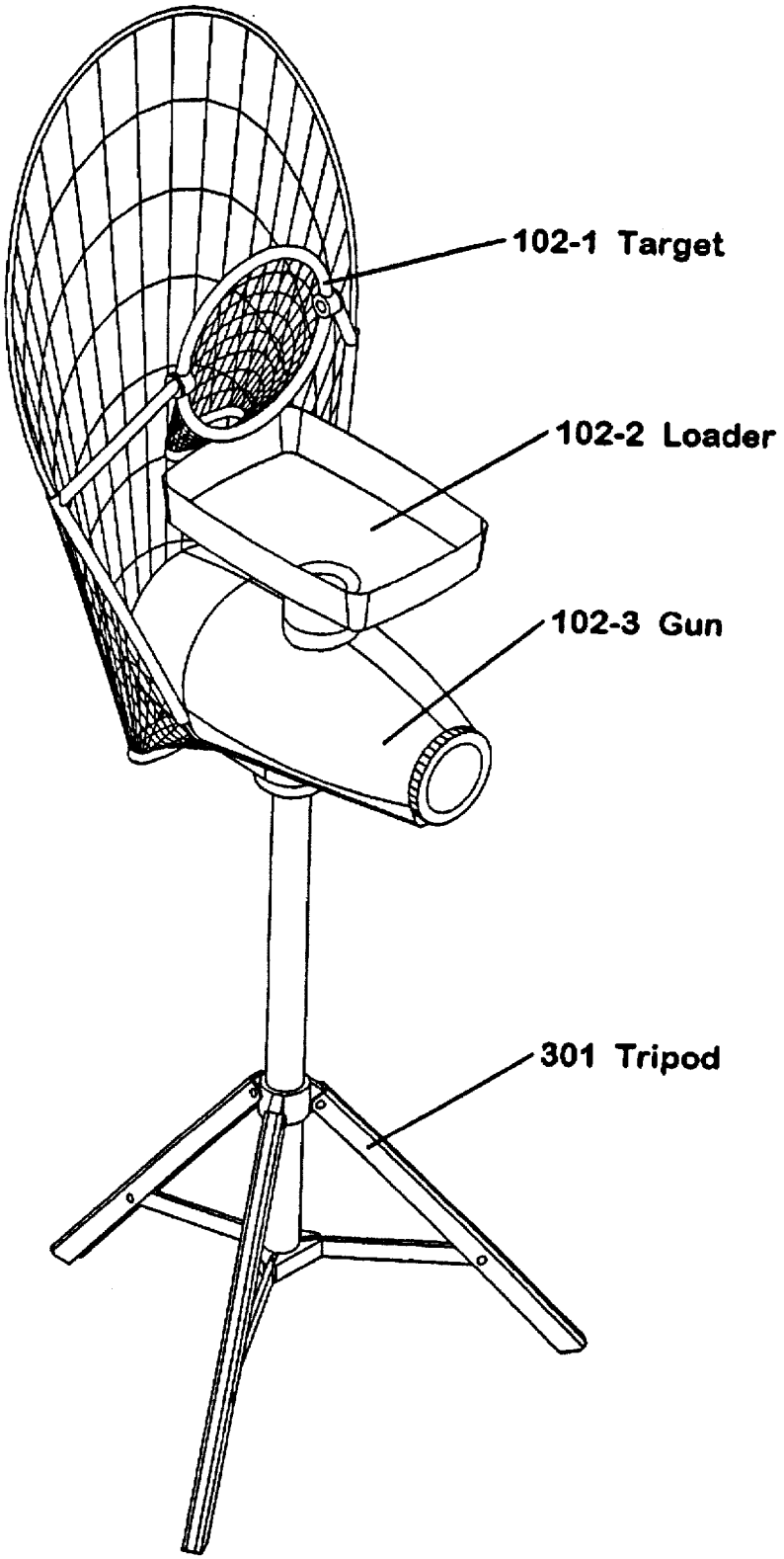
FIG. 3 illustrates the shooter (102 of FIG. 1, including the target, the loader and the gun)

Referring to FIG. 3, the shooter 102 contains three major components: the target 102-1, the loader 102-2 and the gun 102-3 (shown here with the enclosure). The target serves as the striking area for the player and collects balls hitting it. The loader stores and feeds balls into the gun. The gun shoots balls out with controlled timing and locus. A tripod 301 is used to support the shooter.

Figure 4:
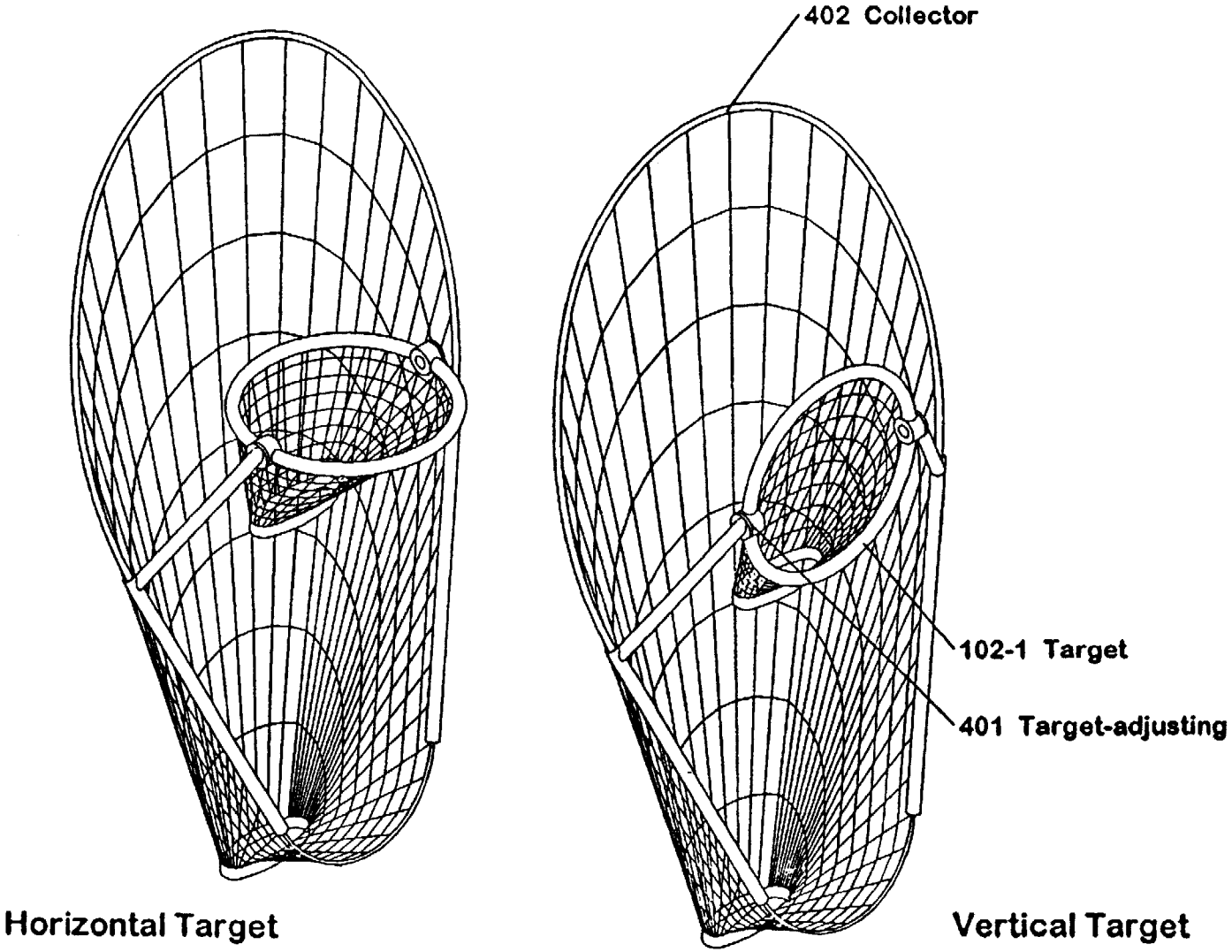
FIG. 4 illustrates the target (102-1 of FIG. 1 ) and the target-adjusting mechanism.

Referring to FIG. 4, the target 102-1 and its adjusting mechanism 401 are designed to collect balls thrown at it by the player, and to facilitate various ball throwing methods. If the target 102-1 stays vertical, the player has to hit it by pitching (like baseball) or punting (like football). If the target 102-1 stays horizontal, the player has to hit it by shooting (like basketball) or tossing (like horseshoe). At the bottom of the target 102-1 is a plastic ring with an oval shape which, when unpressed, keeps balls inside; and when pressed, releases balls from the target 102-1. The target 102-1 can be optionally designed as an automatically moving or on-off target. Also shown in the figure, enclosing the target 102-1 (diameter about 8 "), is a larger oval-shaped collector 402 (size about 18"×24") for collecting balls missing the target 102-1. At the bottom of the collector is an oval-shaped plastic ring, with exactly the same function as the one for the target 102-1.

Figure 5:
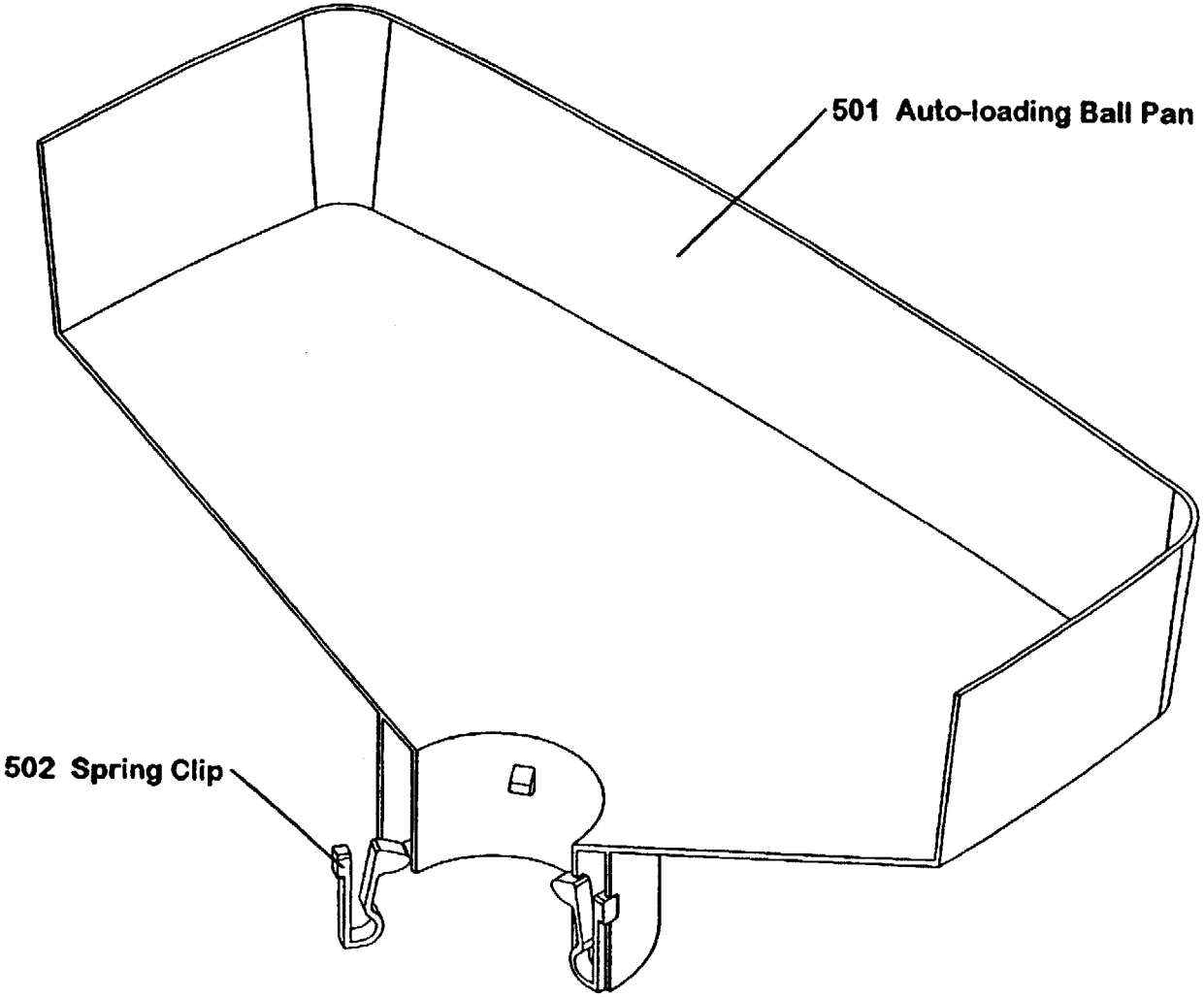
FIG. 5 illustrates the loader (102-2 of FIG. 1) and the loading mechanism.

Referring to FIG. 5, the loader 102-2 is essentially an auto-loading ball pan 501 (size about 8.5"×12 "). The ball pan 501 can be removed from the gun 102-3 to collect and store balls before game starts. At the bottom of the ball pan 501, there are three spring clips 502. These clips 502 hold balls inside the ball pan 501 before loading. Once the ball pan 501 is inserted onto the top of the gun 102-3, the three spring clips 502 are pressed inside, and balls fall freely into the gun 102-3. As the gear-train (603 described later) of the gun 102-3 rotates and the two-motor flywheel (602 described later) spins and shoots ball out, the agitation created ensures smooth loading of balls from the ball pan 501 into the gun 102-3.

Figure 6:
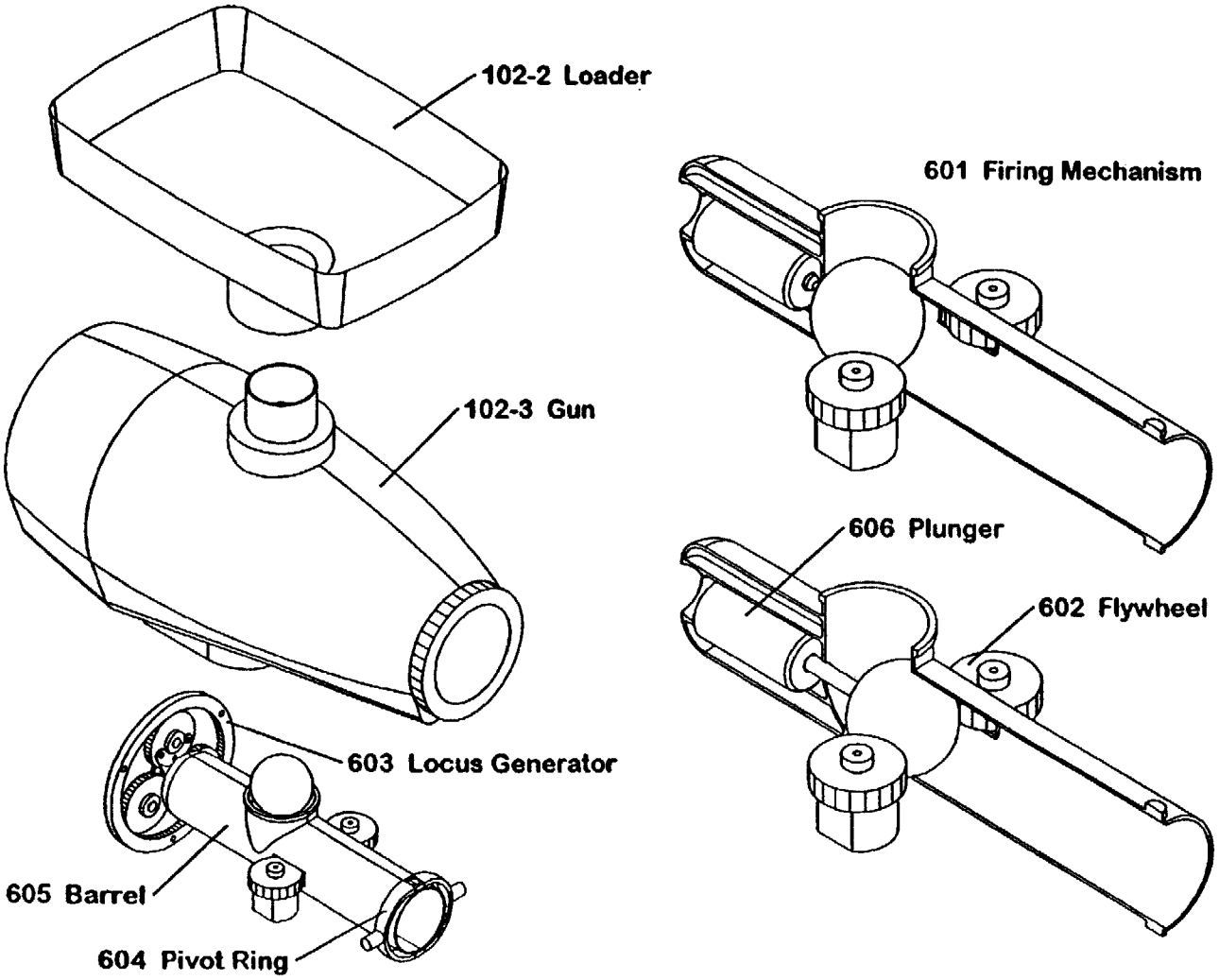
FIG. 6 illustrates the gun (102-3 of FIG. 1 ) and the shooting mechanism.

Referring to FIG. 6, the gun 102-3 (shown here with and without the enclosure, with a length of about 13 ") contains three major components: the loading/firing mechanism 601, the two-motor flywheel-spin mechanism 602, and the ball locus generating mechanism 603. Balls that fall from the loader 102-2 into the gun 102-3 would stay there until the electronic shot controller (sitted behind the ball locus generating mechanism 603 and inside the gun enclosure) activates a solenoid plunger 606 to push them (one at a time) into the two-motor flywheel assembly 602. The two flywheel motors 602 keep free running until a ball is pushed into between them. The flywheel spin force created by the two motors 602 then spins the ball out. After that, the two motors 602 would slow down a bit, but would quickly pick up speed and ready to spin out the next ball. The speed of spinning-out balls can be varied to facilitate different level of plays by adjusting the rotational speed of the two motors 602.

The ball-locus control mechanism 603 uses a planetary gear-train (described below) to generate the ball locus (described below). The elevation angle of the gun 102-3 can be adjusted (using a simple mechanism located at the junction of the gun 102-3 and the supporting tripod 301) from 0 to 5 degrees to facilitate striking-area adjustment for different players. A pivot ring 604 (see also FIG. 7), locked to the front of the gun 102-3, connects the gun barrel 605 to the gun enclosure (with the two horizontal sticks) and balances the gun barrel 605 while it moves along the locus generated by the planetary gear train 603.

Figure 7:
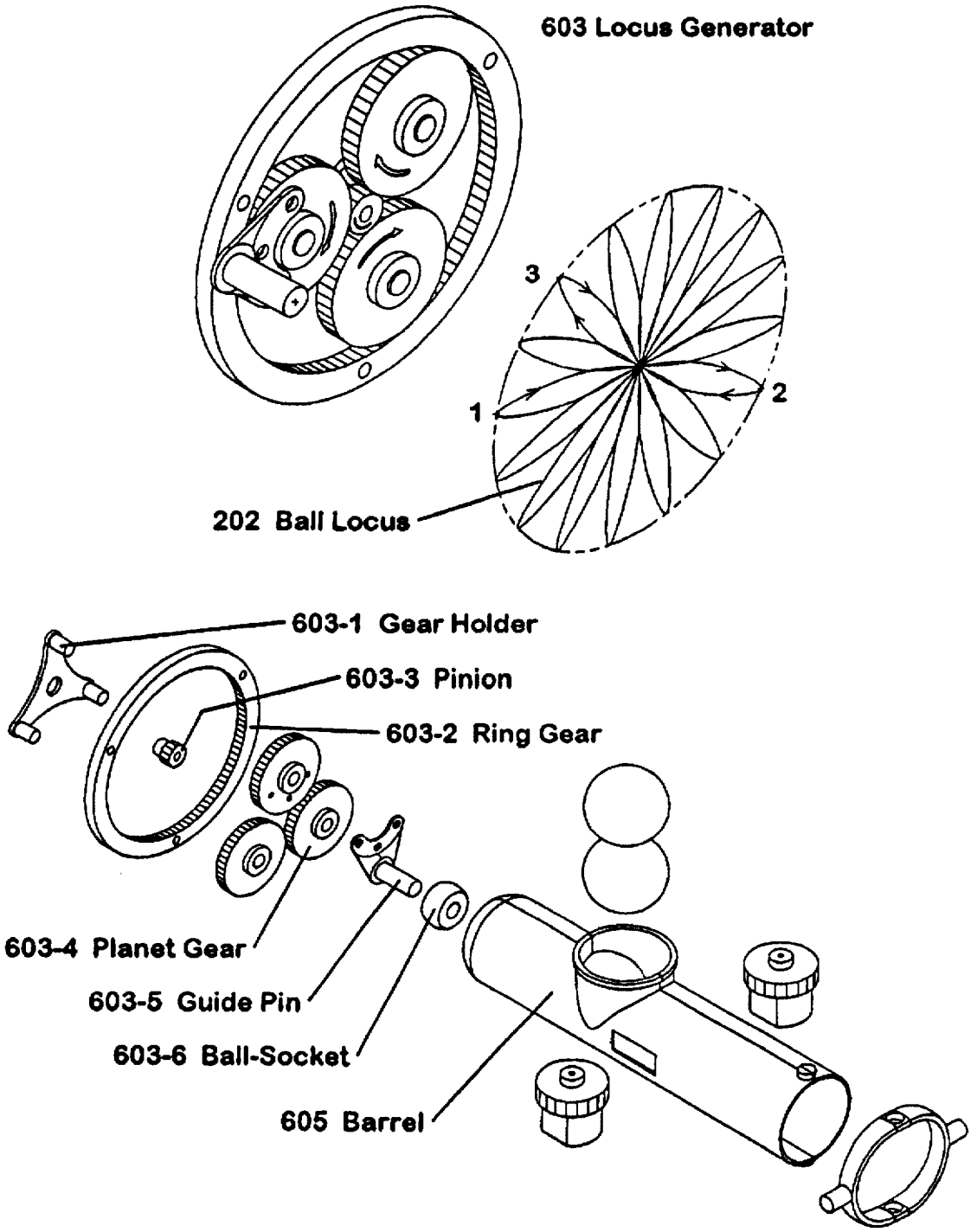
FIG. 7 illustrates the ball locus generating mechanism (603 of FIG. 6)

Referring to FIG. 7, the ball locus generating mechanism 603 of the gun 102-3 uses a planetary gear-train. A gear holder 603-1 holds the three planet gears 603-4 together. The pinion 603-3, connected to a motor, provides the rotation required to generate the ball locus. The three planet gears 603-4, coupled to the pinion 603-3, each self-rotates and, as a whole, also rotates along the outside, fixed ring gear 603-2. A yoke/guide-pin assembly 603-5, locked to one of the planet gears 603-4, and connected, through a ball-socket 603-6, to the end of the gun barrel 605, converts the planet-gear movement into a locus of the gun barrel 605, which in turn generates the ball locus. The ball locus 202 (herein generated by using a combination of a ring gear, a planet gear, and a pinion with predetermined tooth-ratios) and the shooting pattern (of the electronic shot controller, described later) together determine the pseudo-random ball-striking points at the net 101.

Figure 8:
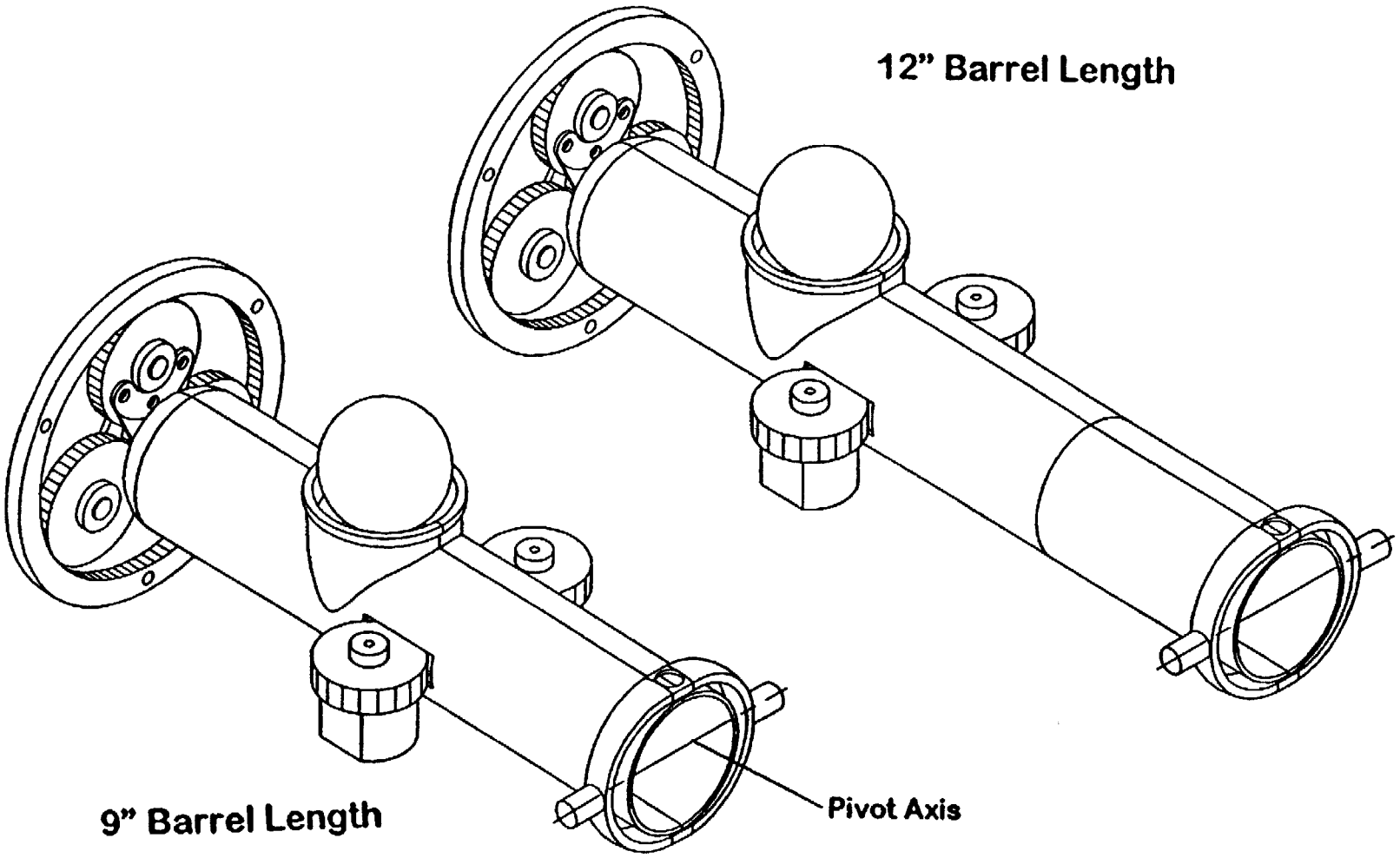
FIG. 8 illustrates the zooming mechanism of the gun.

Referring to FIG. 8, the length of the gun barrel 605 (measured as the distance from the center of the ball-socket 603-6 to the pivot axis) can be varied for zoomed operation. Since the guide pin 603-5 moves along a circle of diameter of about 4.5", and the distance between the pivot axis and the net 101 is about 12', for a fixed barrel length 605 of about 10", the striking area in the net 101 has a circle diameter of about 5.4'. For zoomed operation with varied gun length 102-3 from about 9" to 12", the corresponding striking areas have circle diameters of about 6 ' and 4.5 ', respectively. This can be used to conveniently adjusting the size of the striking area for players with different heights, such as children and adults. Combined with a net 101 with adjustable height and width, the zooming gun can also be used to facilitate different level of plays, e.g., larger striking area means more player's movement.

Figure 9:
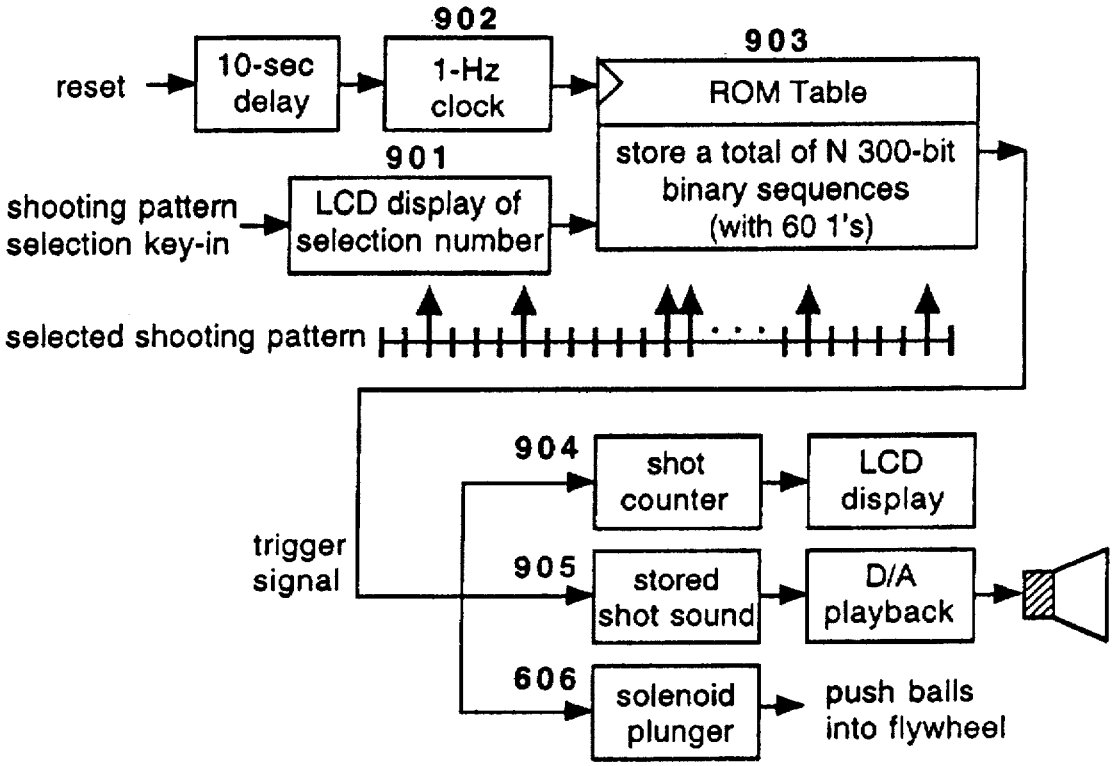
FIG. 9 illustrates the electronic shot controller.

Referring to FIG. 9, the electronic shot controller generates shot signals to activate ball shooting. First, a number is keyed-in to select a shooting pattern (one out of N patterns where N can be any number, herein assuming about 10 to 25), with the selected number displayed by an LCD display 901. The reset signal to start the shooter 102-3 is then delayed by about 10 seconds before starting a 1-Hz clock 902 to serially clock-out the stored bit stream (ROM table 903) of the selected shooting pattern. Each shooting pattern contains 300 bits which corresponds to 300-second play time for a 1-Hz clock 902. The 1's contained in the bit stream activates the shooting. A total of 60 1's are contained in each 300-bit pattern for shooting out all balls stored in the ball pan 501. The shooting patterns are designed to facilitate different level of plays. For example, for children's play, the 1's are more regularly spaced within the 300-bit pattern (see pattern 1); while for adult's play, several 1's could be concentrated together for more difficult plays (i.e., several balls are shot out in a short period of time; see pattern N). The selection numbering is arranged to reflect the difficulty of play-levels, e.g., lower numbers indicate easier play patterns.

The "1" bits within the shooting pattern serve as trigger signals to activate three parts: a shot counter 904 for LCD display to show how many balls have been shot out; a (1-second) digitally-stored shot sound 905 for digital-to-analog (D/A) playback with a small speaker; and a solenoid plunger 606 to push balls (one at a time) into the flywheel motor-assembly 602 for spinning out.

The above descriptions serve to illustrate the preferred embodiments of the present invention. Other modifications and variations to the invention will be apparent to those skilled in the art from the foregoing disclosure and teachings. Thus, while only certain embodiments of the invention have been specifically described herein, it will be apparent that numerous modifications may be made thereto without departing from the spirit and scope of the invention.

For the amusement exercise system of the present invention, what is claimed is:

1. A system comprising a machine delivering a plurality of different or differently-identified objects toward a person or a person-manipulated device, wherein said objects being classified into two classes, wherewith said person or person-manipulated device responding to said different or differently-identified objects by making physical contact with one class of said objects and not making physical contact with the other class of said objects; and further including an offensive scoring method wherein said person or person-manipulated device delivering a plurality of objects toward said machine, with said machine further including an apparatus receiving said objects being delivered by said person or person-manipulated device, wherein said offensive score being set as the number of said objects being received by said apparatus.

2. The system of claim 1, wherein said apparatus comprising a target serving as the delivery destination of said objects by said person or person-manipulated device, and a collector for receiving said objects missing said target.

3. The system of claim 2, wherein said apparatus further including a target-adjusting mechanism placing said target at a plurality of angles facilitating a plurality of methods for delivering said objects by said person or person-manipulated device toward said target.

4. The system of claim 2, wherein said apparatus further including elastic openings located at the bottom of said target and said collector, respectively, facilitating either keeping said objects inside or releasing said objects from said target and said collector.

5. The system of claim 1, further including a system function allowing said person or person-manipulated device delivering said objects toward said machine only in certain time slots indicated by an apparatus.

6. The system of claim 5, wherein said apparatus being an electronic counter counting the number of objects having been delivered toward said person or person-manipulated device by said machine, wherein said electronic counter switching on and off a light indicating time slots in which said person or person-manipulated device being allowed delivering objects toward said machine.

7. A system comprising a machine delivering a plurality of different or differently-identified objects toward a person or a person-manipulated device, wherein said objects being classified into two classes, wherewith said person or person-manipulated device responding to said different or differently-identified objects by making physical contact with one class of said objects and not making physical contact with the other class of said objects; and wherein said machine being an apparatus for objects delivery, comprising a delivery mechanism and a rotary transmission mechanism, the latter mechanism automatically generating a predetermined destination locus of said objects covering a predetermined area, with destination points continuously moving along said locus in a predetermined manner as time progressing, endlessly repeating such traversing of said destination locus as said apparatus continues operating.

8. The apparatus of claim 7, wherein said rotary mechanism being a planetary gear-train, wherein a gear holder holding three planet gears together; a pinion, being connected to a motor, providing the rotation required to generate said destination locus; said three planet gears, being coupled to said pinion, each self-rotating and, as a whole, also rotating along the outside, fixed ring gear; a yoke and guide-pin assembly, locked to one of said planet gears, being connected through a ball-socket to a barrel of said apparatus, converting said planet-gear movement into locus of said barrel, in turn generating said destination locus.

9. The apparatus of claim 8, wherein said destination locus being predetermined and being generated using said planet gears, pinion and ring gear with predetermined gear tooth ratios of 42T, 12T and 96T, respectively.

10. The apparatus of claim 8, further including a zooming mechanism wherein the length of said barrel being variable for zoomed operation, allowing adjustment of the destination-area size of the delivery.

11. The apparatus of claim 7, further including an electronic device generating triggering signals facilitating a plurality of different timing patterns in delivering said objects, wherein said destination locus and said timing patterns together determining the pseudo-random destination of said objects being delivered into a predetermined area.

12. The apparatus of claim 11, wherein said timing patterns being predetermined binary patterns with 1's triggering delivery of said objects and 0's not triggering delivery, the total number of 1's and 0's being equal to the total time units of one system-operation session, with the number of 1's equaling the total number of objects to be delivered, said predetermined binary patterns facilitating selection of different delivery timing patterns of said objects.

13. The apparatus of claim 7, further including a container and a mechanism facilitating removal of said container from said apparatus to collect and store said objects, and facilitating automatic loading of said objects from said container into said apparatus for delivery.

14. The mechanism of claim 13, wherein said mechanism comprising three spring clips at the bottom of said container, wherein when not pressed, said spring clips holding said objects inside said container, and when pressed, as said container being inserted into said apparatus, facilitating automatic loading of said objects into said apparatus for delivery.

* * * * *